US005908670A

United States Patent [19]

Dunkerley et al.

[11] Patent Number: 5,908,670

[45] Date of Patent: Jun. 1, 1999

[54] APPARATUS FOR ROTARY SPRAYING A METALLIC COATING

[75] Inventors: Joseph P. Dunkerley, Derry; Thomas A. Friedrich, Loudon, both of N.H.; Gary Irons, Indianapolis, Ind.

[73] Assignee: Tafa, Incorporated, Concord, N.H.

[21] Appl. No.: 08/960,998

[22] Filed: Oct. 30, 1997

Related U.S. Application Data

[63] Continuation of application No. 08/670,767, Jun. 24, 1996, abandoned.

[51] Int. Cl.[6] ..... C23C 4/12

[52] U.S. Cl. ..... 427/449; 427/446; 219/76.14; 219/76.16; 239/81; 239/83

[58] Field of Search ..... 427/446, 449, 427/236; 219/76.14, 76.16; 239/79, 81, 83

[56] References Cited

U.S. PATENT DOCUMENTS

| | | | |
|---|---|---|---|
| 1,968,992 | 8/1934 | Conkling | 91/44 |
| 2,610,092 | 9/1952 | Thompson | 299/140.1 |
| 3,901,441 | 8/1975 | Kasagi | 239/81 |
| 4,464,414 | 8/1984 | Milewski et al. | 427/37 |
| 4,681,258 | 7/1987 | Jenkins et al. | 427/236 |
| 4,853,513 | 8/1989 | Fuimefreddo | 219/76.14 |
| 4,937,417 | 6/1990 | Fox | 219/76.1 |
| 4,978,557 | 12/1990 | Drake et al. | 427/37 |
| 4,986,477 | 1/1991 | Roman | 239/455 |
| 4,992,337 | 2/1991 | Kaiser et al. | 428/642 |
| 5,017,757 | 5/1991 | Kawai et al. | 219/130.51 |
| 5,066,513 | 11/1991 | Zurecki et al. | 427/37 |
| 5,109,150 | 4/1992 | Rogers | 219/121.47 |
| 5,143,139 | 9/1992 | Leatham et al. | 164/46 |
| 5,145,710 | 9/1992 | Quadflieg et al. | 427/34 |
| 5,148,990 | 9/1992 | Kah, Jr. | 239/222.17 |
| 5,191,186 | 3/1993 | Crapo, III et al. | 219/76.16 |
| 5,194,304 | 3/1993 | McCune, Jr. et al. | 427/449 |
| 5,442,153 | 8/1995 | Marantz et al. | 219/121.47 |
| 5,460,851 | 10/1995 | Jenkins | 427/199 |
| 5,466,906 | 11/1995 | McCune, Jr. et al. | 219/121.47 |
| 5,468,295 | 11/1995 | Marantz et al. | 118/723 |
| 5,476,222 | 12/1995 | Singer et al. | 239/99 |

FOREIGN PATENT DOCUMENTS 9112183 8/1991 WIPO .

*Primary Examiner*—Katherine A. Bareford
*Attorney, Agent, or Firm*—Hayes, Soloway, Hennessey, Grossman & Hage, P.C.

[57] ABSTRACT

An apparatus for coating a part with a metallic coating comprising at least two consumable electrically conductive metallic wire electrodes converging to converging point at their ends, an electric current into said wires creating an arc and melting said wire ends forming an arc ball, an atomizing gas supply supplying gas to said converging point of said wires to convert said arc ball into a molten particle stream, and a deflecting gas valve assembly disposed outwardly of said consumable wires, said deflecting gas valve assembly deflecting gas from a direction which is rotatable relative to said two wires, said deflecting gas valve assembly containing a plurality of ports relative to and behind said molten particle stream supplying a steady flow of deflecting gas thereby deflecting said molten metal particle stream radially outward towards a surface to be coated.

15 Claims, 5 Drawing Sheets

APPARATUS FOR ROTARY SPRAYING A METALLIC COATING

This is a continuation of application Ser. No. 08/670,767 filed on Jun. 24, 1996, now abandoned.

The present invention relates to a rotating spray system which provides an apparatus and a method to coat the inside surfaces of a part with an arc spray when it is difficult or not possible to rotate the part. In particular, the present invention describes an arc spray gun containing an air knife, or lines of deflecting air jets, wherein the only part of the gun head that rotates is the atomizing air jet which is focused upon the metal droplets of an arc ball, or molten particles, in a manner which assures good atomization and projection of a well defined and uniform spray stream. In addition, the present invention describes the use of a compensator means (a lower rear airjet) which is placed on the air knife which forms the arc ball so as to maintain and prevent the arc ball from contacting the knife.

BACKGROUND OF THE INVENTION

Numerous types of thermal spray coating methods and systems are known in the prior art. In general, such methods comprise the deposition of a wire or powdered material onto a surface to be coated. In one particular process, known as electric-arc (two wire) spray coating, two consumable wires form electrodes of an electric arc or "arc ball". The two wires are electrically energized and converge at a point in which the electric arc is formed. A stream of compressed atomizing gas is passed through the converging point to atomize the molten material and drive a molten metal particle stream formed by the electric arc along an axis forward of the converging zone.

Various prior patents discuss electric-arc spray systems, noteworthy of which include U.S. Pat. Nos. 1,968,992 (apparatus for coating surfaces), 2,610,092 (spray discharge nozzle), 4,464,414 (method for spraying metallic coatings), 4,992,337 (electric arc spraying of reactive metals); 5,066,513 (method of producing titanium nitride coatings by electric arc thermal spray); 4,937,417 (metal spraying apparatus); 4,98,557 (method of arc spraying); 4,986,477 (spray gun with adjustment of the shape of the jet); 4,992,337 (electric arc spraying of reactive metals); 5,017,757 (pulsed arc welding machine); 5,109,150 (open-arc plasma wire spray method and apparatus); 5,143,139 (spray deposition method and apparatus); 5,145,710 (method and apparatus for applying a metallic coating to threaded end sections or plastic pipes and resulting pipe); 5,148,990 (adjustable arc spray and rotary stream sprinkler); 5,191,186 (narrow beam arc spray device), 5,194,304 (method of thermally spraying solid lubricant onto a metal target), 5,442,153 (high velocity electric-arc spray apparatus and method of forming materials); 5,466,906 (process for coating automotive engine blocks) and 5,468,295 (apparatus and method for thermal spray coating of interior surfaces).

More specifically, of the above listed patents, U.S. Pat. No. 5,468,295 to Marantz describes a thermal spray coating apparatus, such as a two wire arc apparatus. The nozzle contains a plurality of pores facing generally inwardly towards a coating material particle stream, such as an atomized molten metal stream of a two-wire arc thermal spray apparatus. The ports sequentially receive a deflecting gas flow, such that the direction moves circumferentially about the axis of the particle stream. The deflecting gas entrains the coating materials and carries it radially to the surface of the part to be coated or the nozzle assembly. When such nozzle is inserted into an engine bore, it is described as radially coating the bore, on its surface.

However, a number of problems exist with the prior art device of Marantz that have been overcome by the present invention First, as a pneumatic device it is less responsive than the electro-mechanical device herein described, and more cumbersome and bulky with-multiple air passages. In addition, by sequencing or strobing the air stream, the Marantz device will tend to overlap the coating layers, whereas the apparatus herein describe provides a true continuous stream coating which can vary over a wide range of rotation rates. Moreover, valving, i.e. switching from one tube to an adjacent tube, is non-linear. Accordingly, it is very difficult by such process to provide a smooth transition from full flow on one set tube to the next. In addition, the lift of the arc ball in the Marantz device must be substantial. This translates into some instability in the radial flow which is further complicated by the comparative size of the orifices which would have a tendency to cause chatter (i.e., intermittent extinguishing of the arc and reignition thereof), and a focused spray (or narrowed pattern) is impossible.

In addition, one pervasive problem with all thermal-arc spraying devices of the prior art, rotatable or otherwise, is that air flow from the air knife has been found to create a negative pressure between the wicket (the area immediately behind the consumable electrodes), and the knife base, as the air flows away from the knife. This negative pressure is believed to be responsible for drawing material from the arc ball and depositing such material onto the knife.

Accordingly, it is a first object of this invention to overcome the aforesaid problems of prior art thermal spray devices and provide a rotating arc spray gun wherein the only part of the gun head that rotates is the atomizing air jet.

More specifically, it is an object of the present invention to overcome the aforesaid problems of the prior art thermal spray devices and provide a rotating arc spray gun wherein a continuous stream coating can be applied over a wide range of rotation rates, and which avoids a sequencing, strobing or pulsed air stream.

In addition, the present invention has as a more specific object the preparation of a rotating arc spray gun wherein a deflecting valve assembly (or air knife) rotates about an arc ball formed by two consumable electrodes and wherein the deflecting valve assembly contains a plurality of ports providing a semi-circular pattern thereby providing a hooped shaped air flow around the arc and a focused radial delivery of an atomized metal coating.

Finally, the present invention has as its object the installation of what can be described as a negative pressure compensator means, in an arc gun containing a deflecting valve assembly (rotatable or stationary). The negative pressure compensator eliminates any negative pressure formed by the effect of the air flow from the deflecting valve assembly as the air flows away from said assembly, thereby maintaining the arc ball in the proper alignment position for efficient coating.

SUMMARY OF THE INVENTION

Figure 1:
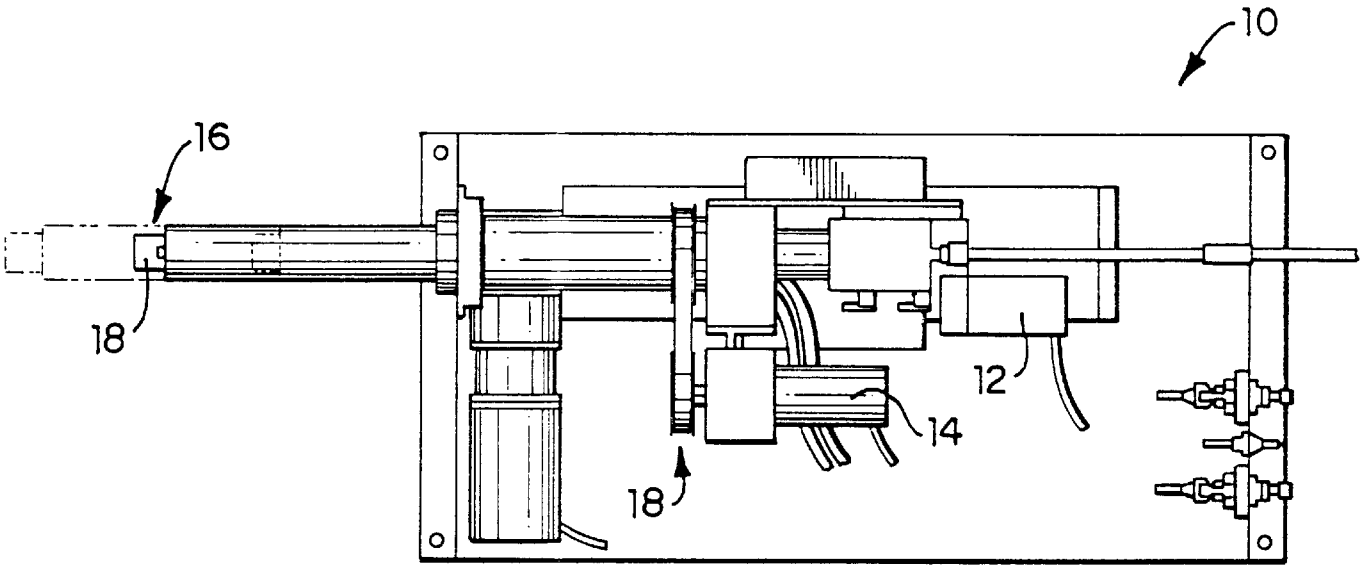
FIG. 1 is a schematic view of the electric-arc coating apparatus incorporating the present invention, without detail of the deflecting gas valve assembly.

An apparatus for coating a part with a metallic coating comprising at least two consumable electrically conductive metallic wire electrodes converging to converging point at their ends, an electric current into said wires creating an arc and melting said wire ends forming an arc ball, an atomizing gas supply supplying gas to said converging point of said wires to convert said arc ball into a molten particle stream, and a deflecting gas valve assembly disposed outwardly of said consumable wires, said deflecting gas valve assembly deflecting gas from a direction which is rotatable relative to said two wires, said deflecting gas valve assembly containing a plurality of ports relative to and behind said molten particle stream supplying a steady flow of deflecting gas thereby deflecting said molten metal particle stream radially outward towards a surface to be coated.

In a further embodiment, an apparatus for coating a part with a metallic coating is disclosed comprising at least two consumable electrically conductive metallic wire electrodes converging to a converging point at their ends, an electric current into said wires creating an arc and melting said wire ends forming an arc ball, an atomizing gas supply supplying gas to said converging point of said wires to convert said arc ball into a particle stream, a deflecting gas valve assembly disposed outwardly of said consumable wires, said deflecting gas valve assembly deflecting gas from a direction which is rotatable relative to said two wires, said deflecting gas valve assembly containing a plurality of ports arranged in a substantially semi-circular line pattern relative to and behind said molten particle stream therein deflecting said molten metal particle stream radially outward towards a surface to be coated.

In a still further embodiment of the present invention, an improvement is disclosed for a thermal spray coating apparatus containing at least two consumable wire electrodes converging at a converging zone to produce a molten metal particle arc ball, including a stream of compressed gas passing through a deflecting gas valve and through said converging zone to atomize said molten metal particle arc ball and drive a particle stream forward of said converging zone, wherein the flow of gas from the deflecting gas valve produces a negative pressure between the arc ball and the deflecting gas valve causing the arc ball to deposit on said deflecting gas valve, the improvement comprising the incorporation of a second flow of gas in the deflecting gas valve not directed at the arc ball and positioned to compensate for said negative pressure between the arc ball and said deflecting gas valve thereby substantially maintaining the arc ball in alignment position in the converging zone for atomization.

In method embodiment, the present invention comprises a method of thermally spraying a metal matrix coating comprising first creating an electrical arc ball into which a consumable strand is fed to produce a melt, the strand being comprised of a consumable electrode, applying a steady flow of deflecting gas from a deflecting gas valve directed at said electrical arc ball and rotating the deflecting gas around said arc ball to project said melt radially outward towards a surface to be coated.

In the method of coating a part according to the present invention, the coating apparatus described above is disposed within a part to be coated. The coating apparatus is moved axially along the surface of the part and while the coating apparatus is moved axially, compressed air is steadily delivered to the plurality of ports positioned relative to and behind the particle stream, and the stream is deflected radially outward towards said part surface to provide a complete and even coating.

DETAILED DESCRIPTION OF THE PREFERRED EMBODIMENTS

As noted above, the present invention provides both an apparatus and a method for thermal spray coating a part when it is not possible to rotate the part. The apparatus includes a single radial atomizing nozzle which rotates about an arc ball. The deflecting nozzle is fed from a single circumferenced plenum (i.e., the deflecting gas valve assembly) without interruption of flow. The deflector preferably employs an array and plurality of staggered ports, in a substantially semi-circular pattern, that direct a hooped shaped air flow around the arc. The ports are preferably relatively small in nature affording a diff-used flow of controlled turbulence to capture and effectively atomize the molten consumable in a radially focused manner. The shaped turbulence so provided avoids direct contact with the arc which would tend to destabilize the arc, and instead vacuums material away using a peripheral contact.

Preferably, the deflecting gas valve assembly contains an additional gas nozzle port disposed on said assembly which directs gas flow axially to the arc and maintains it in line with the atomizing gas supply pathway. Such additional gas nozzle port also prevents blow down of the arc as well as directing air flow to lift the arc and maintain it in a column of gas which symmetrically equalizes the arc ball for radial focused dispersal.

It is important to note that the above additional gas valve nozzle port, while described as a preferred aspect of the present invention, is not limited in its application or placement on the rotating and deflecting gas valve assembly as herein described. That is, as noted earlier, in all thermal-arc spraying devices containing two consumable wire electrodes converging at a converging zone to produce a molten metal particle arc ball, the air flow from the deflecting gas assembly (or "air knife") tends to create a negative pressure at that area immediately behind the consumable electrodes (the "wicket"). This negative pressure then draws material from the arc ball and deposits it onto the knife. Accordingly, the present invention provides an improvement to such problem, by incorporation of a second flow of gas in the deflecting gas assembly not directed at the arc but positioned to compensate for said negative pressure and thereby substantially maintaining the arc ball in position in the converging zone for atomization.

Preferably, this second flow of gas emerges from an opening that can be described as having an orphic configuration and which originates at the base of the air knife. This provides a spray of a limited amount of gas up and out between the wicket and the air knife. This flow is not directed at the arc ball, and instead serves to eliminate negative pressure and maintains the arc ball in the correct direction away from the knife.

With reference to FIG. 1, illustrated at 10 is a basic schematic view of the present invention. Illustrated therein at 12 is the wire drive which serves to advance the consumable electrodes for subsequent atomization, and at 13 is the drive motor for axial positioning of the device. At 14 is the means for rotating the deflecting gas assembly 16 and said means for rotating is illustrated as attaching to a pulley which rotates the deflecting gas assembly around the consumable electrodes. Rotation of between 100–400 rpm can be conveniently and preferably achieved by such construction.

Figure 2:
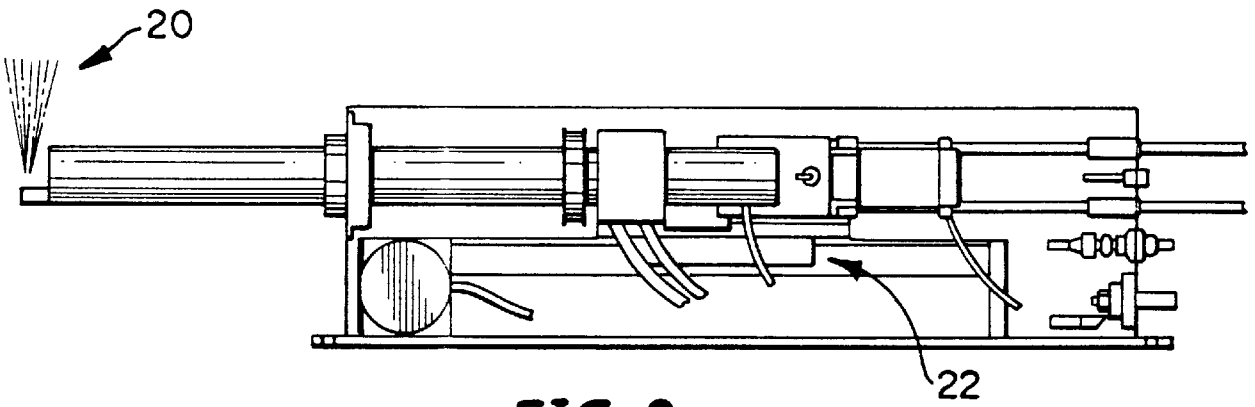
FIG. 2, is a further schematic view of the electric-arc coating apparatus of the present invention, illustrating a radial spray pattern generated, without detail of the deflecting gas valve assembly.

Specifically, and again with reference to FIG. 1, shown at 18 is the general location for the preferred plurality of ports positioned relative to and behind the resulting and radially projected molten particle stream (not shown). This is all better illustrated in FIG. 2, wherein the deflecting gas assembly which provides a steady flow of deflecting gas deflects the molten particle stream 20 radially outwardly towards a surface to be coated. Also shown in FIG. 2 is slide table 22 which allows for axial movement of the deflecting gas assembly so that a complete and even coating can be applied to, e.g., a cylinder bore of an automobile engine. Of course, it can be appreciated that as described, the present invention is not limited to cylinder bores, and has specific utility for any type of substrate surface wherein it is difficult or impossible to rotate and provide access by a conventional thermal spray coating apparatus.

Figure 3:
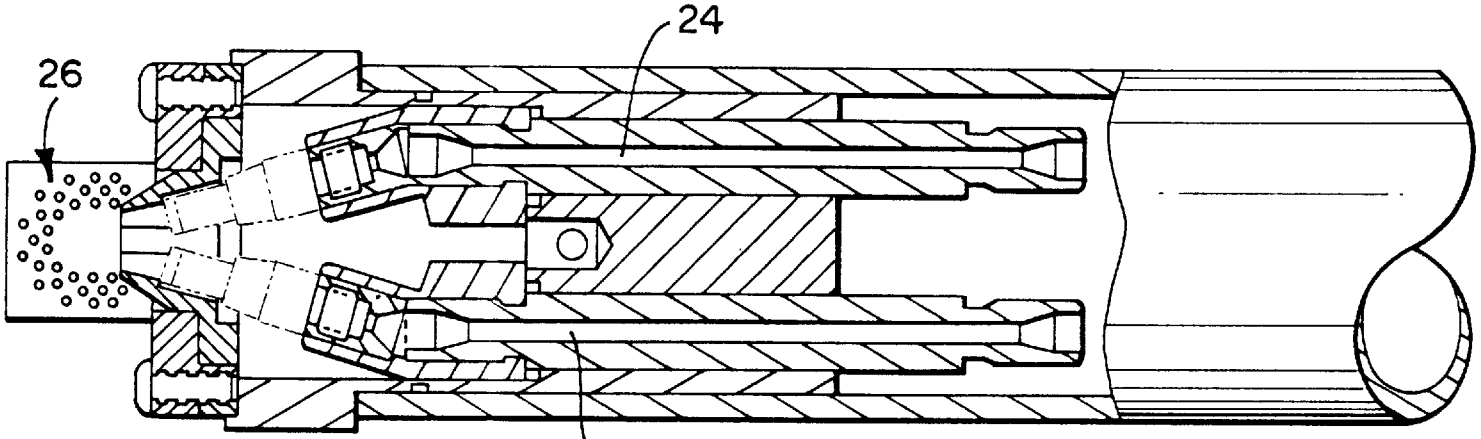
FIG. 3 is a more detailed schematic view of the present invention illustrating the wire path, and the preferred semicircular pattern on the deflecting valve assembly, in a non-rotating version.

With reference to FIG. 3, greater detail is provided regarding the invention disclosed herein. Specifically, the consumable electrodes are positioned at and along position 24 so that in use, said consumable electrodes serve to provide the material for formation of the arc ball. Preferred material for the consumable electrode include steel, stainless steel, bronze, nickel, chrome, and mixtures thereof In regards to the additional detail provided for in FIG. 3, which illustrates in a cross-sectional view the wire pathways, shows at 26 the preferred plurality of ports positioned behind the molten metal particle stream (not shown) and which ports are preferably arranged in a substantially semi-circular pattern. This in effect provides what can be termed a hoop pattern to the arc ball. Preferably, the plurality of semi-circular patterns are arranged at 0.18, 0.25 and 0.31 in radial inches from the tip of the wire electrodes, which provides a plurality of hoop patterns, the inner hoop tending to atomize the consumable electrodes, and the outer hoops tending to consolidate the spray pattern for radial coating. Finally, it is to be noted that preferably it has been found that the gas flow out of these semi-circular ports are arranged in the range of about 50–75 cfm.

Figure 4:
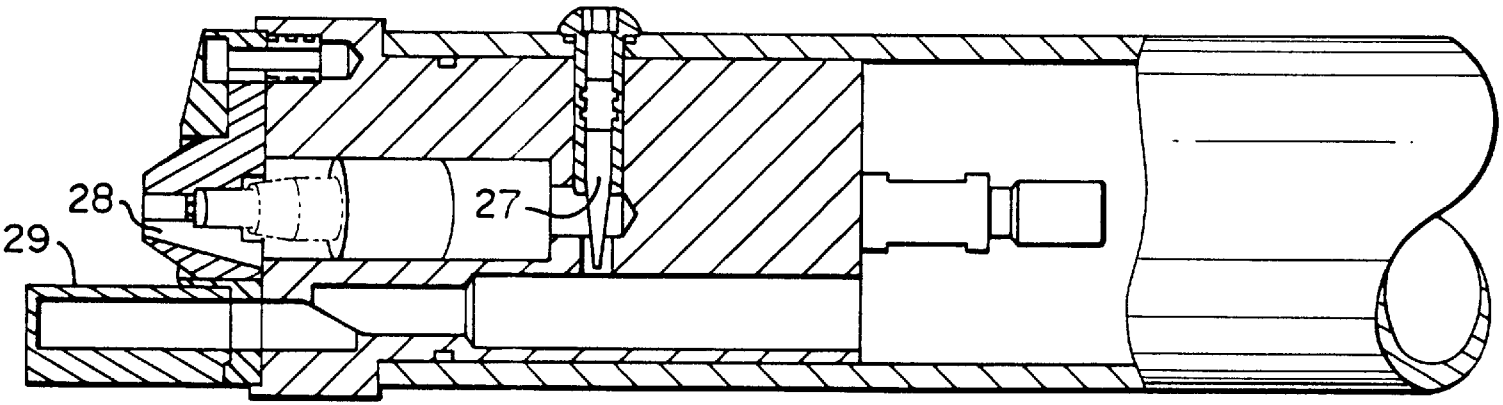
FIG. 4 is yet another detailed schematic view of the present invention, illustrating gas flow, but in a non-rotating version.
Figure 5:
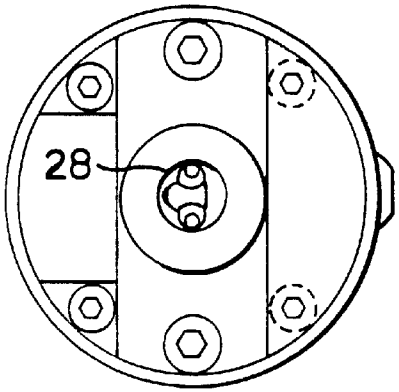
FIG. 5 is another detailed schematic view of the present invention, in a non-rotating version, illustrating the preferred additional gas nozzle port or negative pressure compensator disposed on the deflecting valve assembly which directs air flow to specifically support the arc and maintain it in line with the atomizing gas supply pathway.

FIG. 4 illustrates a cross-sectional view of the air pathways and shows at 27 a needle valve assembly for adjusting axial air flow in relation to the radial air flow provided by the deflecting gas valve assembly. FIG. 5 illustrates an end view of the spray head, and at 28 can be seen the negative pressure compensator. It is to be noted that, as shown, the negative pressure compensator may be part of the tip positioner, or the compensator itself can be located at position 29 as illustrated on FIG. 4.

Figure 6:
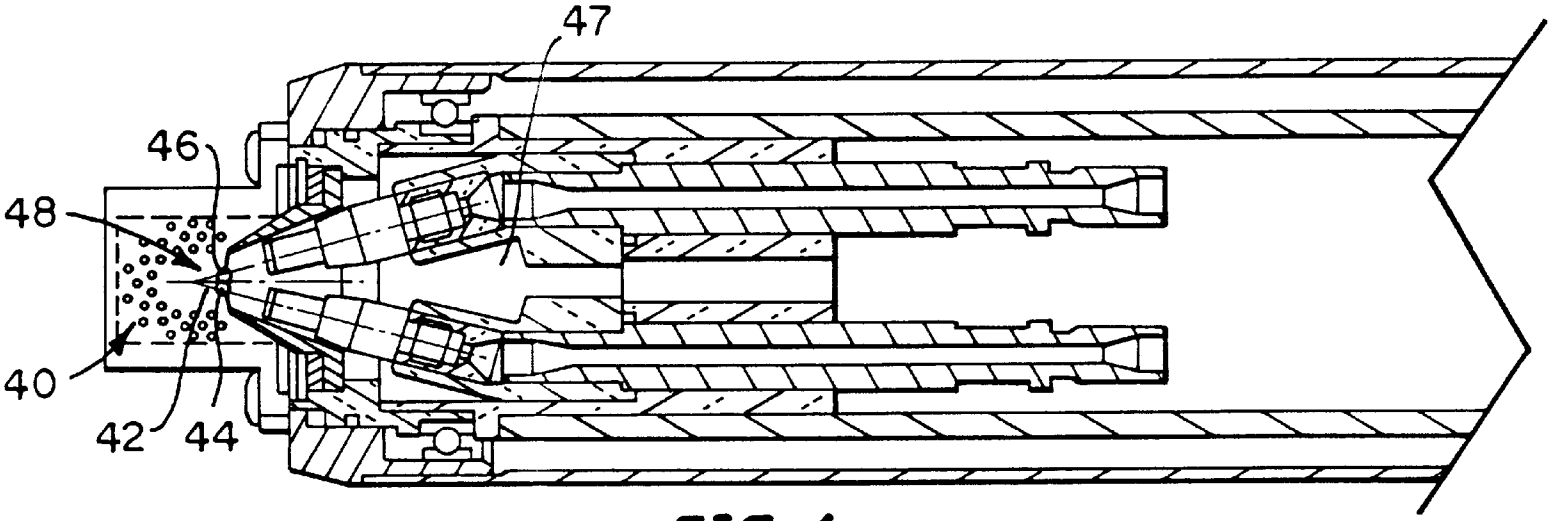
FIGS. 6 and 7 are yet another detailed schematic view of the present invention in rotating version thereof.

FIG. 6 illustrates at 40 the previously noted and preferred semi-circular pattern providing a hoop pattern to the consumable electrodes, now more clearly shown at 42. Also shown at 44 and 46 is the placement of the preferred orphic configuration ports which provides a second flow of gas not directed at the tip of the electrodes 42, but rather at that area between the wicket (the area immediately behind the consumable electrodes, shown at 48 and the deflecting gas valve base. By so placing the ports 44 and 46, the arc ball which will appear generally in the region of 42 will not deposit on the semi-circular pattern 40 of the valve. Finally, shown at 47 is the gas flow chamber which provides an axial gas flow to drive forward the particle stream formed by the consumable electrodes for radial deflection.

With regards to air flow 47, preferably, the gas flow is set at about 10 cfm with 5–20 psi pressure. However, this gas flow may be modified to accommodate the consumable electrode wire composition and modify the desired spray pattern. Spray patterns can be altered by modifying the voltage, and the axial pressure. Whereas voltage adjustments cause subtle changes in the spray pattern but major changes in the coating, modifying the axial pressure causes major changes in the spray pattern but minor changes in the coating. Low axial pressure constricts the spray pattern into a small diameter, 1.0 inches plus at 3.5 inches with a spray angle of 90 degrees. High axial pressure both widens the diameter of the pattern from 1.0 inches plus, to 2.5 inches plus at 3.5 inches, and increases the spray angle from 90 degrees to 100 or 120 degrees. In addition, start-up of the spray while the air knife is rotating can be greatly facilitated by increasing the axial flow to about 60 psi, reducing it to the spray parameter for the cycle.

Figure 7:
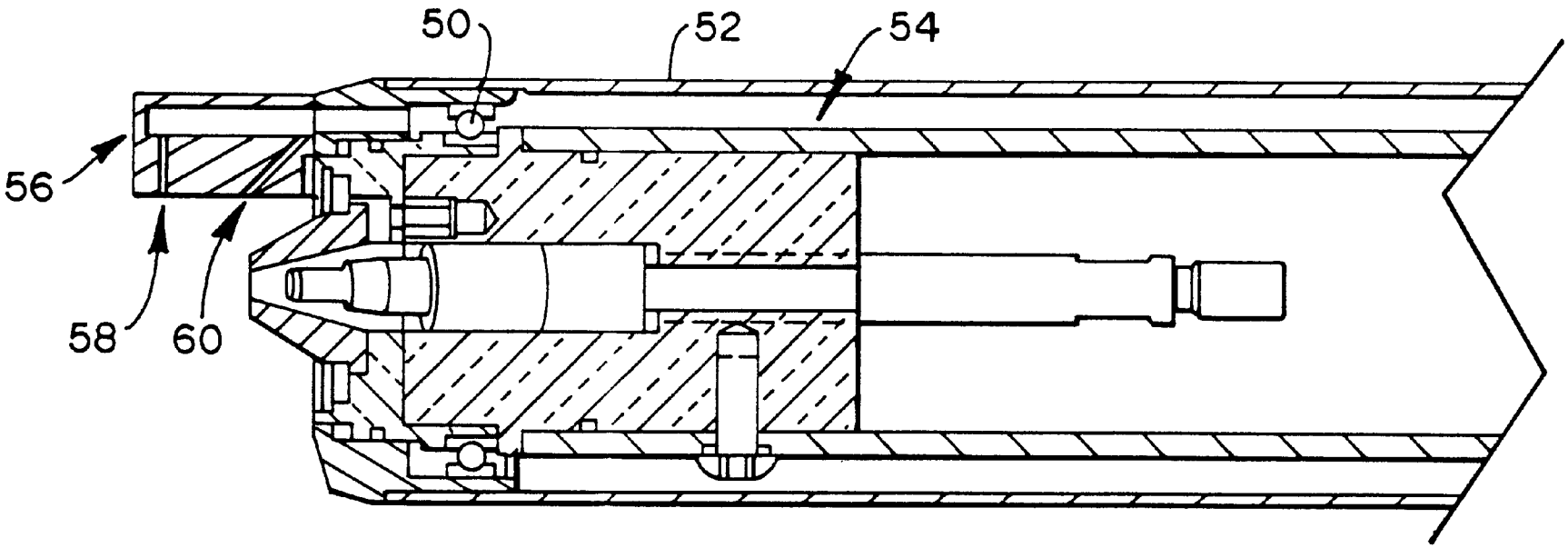
Figure 8A:
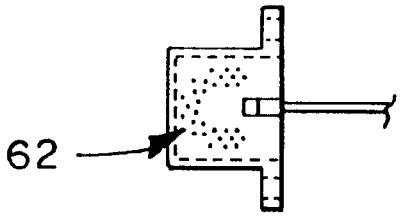
FIG. 8A is a detailed schematic face view of the deflecting valve gas assembly, illustrating the preferred plurality of ports disposed on said gas assembly in a substantially semi-circular pattern.
Figure 8B:
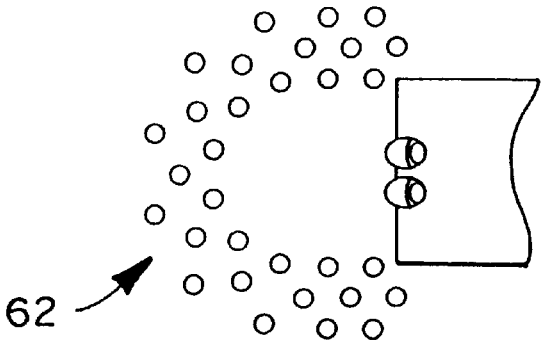
FIG. 8B is an ever further detailed view of the port configuration.
Figure 8C:
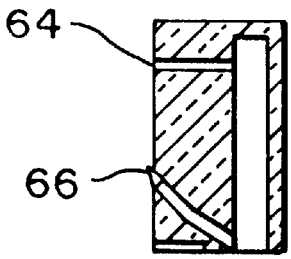
FIG. 8C is a cross-section illustration of FIG. 8B indicating the preferred air flow through the valve assembly in operation.

FIG. 7 illustrates the placement of the bearing 50 so that the deflecting valve assembly, now shown at 56, can be readily rotated. Shown at 54 is the chamber for air flow to the deflecting gas valve assembly, enclosed by tube wall 52. Shown at 58 is one of the individual gas ports within the plurality of semi-circular patterns and at 60 a side view of one of the preferred orphic configuration ports. FIG. 8A illustrates in greater detail the preferred deflecting gas valve assembly or air knife, with the preferred plurality of individual gas ports 62 configured in a plurality of semi-circular patterns. A blow-up of this pattern is illustrated in FIG. 8B. As illustrated, the ports are preferably staggered from one another and positioned 15° apart in their preferred configuration. This pattern is positioned so as to surround the arc ball and focus the deposition of the consumables without disrupting the axial air flow, thus working together with said axial air flow to properly direct and atomize the molten consumables. Finally, FIG. 8C which is a cross-section of FIG. 8B, illustrates at 64 the preferred air flow through the atomizer in, and at 66 the air flow for feeding the negative pressure compensator.

In a preferred application of both the method and apparatus herein disclosed, the internal surfaces of a plurality of spaced apart bores may be coated. For example, an engine block may include two, four, six or eight parallel bores. Where the engine block is aluminum, the bores are preferably coated with a hard metal coating to reduce wear. As alluded to above, it is inconvenient to rotate the engine block about each bore, which would be necessary with a conventional thermal spray device of the prior art. The thermal spray apparatus of the present invention is conveniently operated to direct the spray radially into the bore and along with axial movement, the spray pattern is directed throughout the length of the bore. Accordingly, by adjustment of the amperage flowing through the consumable electrodes, together with the deflecting valve gas assembly disclosed herein, uniform coating thickness can now be achieved in coated cylinder bores made in accordance with the rotating arc spray system as disclosed herein.

While the above invention has been described in terms of various preferred embodiments, it will be appreciated that other forms could readily be adapted by one skilled in the art. It is therefore appreciated that within the scope of the appended claims, the invention may be practiced otherwise than described.

We claim:

1. A method of thermally spraying a metal matrix coating comprising supplying an arc ball into which a consumable strand is fed to produce a melt, the strand being comprised of a consumable electrode, applying a steady uninterrupted encapsulating flow of deflecting gas through a multiport gas nozzle directed at said arc ball at substantially equivalent flow through all of said ports in said multiport nozzle to provide a substantially unified flow pattern, and rotating said multiport gas nozzle around said arc ball to project said melt radially and continuously outward towards a surface to be coated, including the introduction of a second flow of gas not directed at the arc ball to substantially maintain the arc ball in position for said outward radial projection.

2. The method of claim 1, wherein the steady flow of deflecting gas is supplied in a substantially semicircular pattern.

3. The method of claim 1, wherein the multiport nozzle supplies a flow of deflecting gas arranged in a semi-circular line pattern.

4. The method of claim 1, wherein the multiport nozzle comprises ports arranged in a plurality of semi-circular line patterns.

5. The method of claim 1, wherein the multiport nozzle comprises 3 semi-circular line patterns which are positioned at about 0.18, 0.25 and 0.31 inches in radial distance from said converging point of said wire electrodes.

6. The method of claim 1, wherein said steady flow of deflecting gas is about 50–75 cubic feet per minute.

7. An apparatus for coating a part with a metallic coating comprising:

at least two consumable electrically conductive metallic wire electrodes converging to a converging point at their ends;

an electric current into said wires creating an arc and melting said wire ends forming an arc ball;

an atomizing gas supply directing gas at said converging point of said wires and flowing substantially around said arc ball to convert said arc ball into a molten particle stream; and a rotating multiport gas nozzle disposed outwardly of said consumable wires, said multiport gas nozzle deflecting gas from a direction which is rotatable relative to said two wires, said multiport gas nozzle containing a plurality of ports relative to and beside said molten particle stream and supplying a substantially steady uninterrupted encapsulating flow of deflecting gas simultaneously through all of said plurality of ports at substantially equivalent flows thereof to provide a substantially unified flow of deflecting gas in substantially the same direction, thereby deflecting said molten metal particle stream radially outward towards a surface to be coated, including a gas port nozzle disposed on said multiport gas nozzle which directs air flow to support the arc and substantially maintain said arc in line with the atomizing gas supply.

8. The apparatus of claim 7 wherein the plurality of ports relative to and beside said molten particle stream supplying a steady flow of deflecting gas are arranged in a semi-circular line pattern.

9. The apparatus of claim 7, wherein the plurality of ports are arranged in a plurality of semi-circular line patterns.

10. The apparatus of claim 7, wherein there are 3 semi-circular line patterns which are positioned at about 0.18, 0.25 and 0.31 inches in radial distance from said converging point of said wire electrodes.

11. The apparatus of claim 7, wherein said steady flow of deflecting gas is about 50–75 cubic feet per minute.

12. An apparatus for coating a part with a metallic coating comprising at least two consumable electrically conductive metallic wire electrodes converging to a converging point at their ends;

an electric current into said wires creating an arc and melting said wire ends forming an arc ball;

an atomizing gas supply directing gas at said converging point of said wires and substantially flowing around said arc ball to convert said arc ball into a particle stream;

a rotating multiport gas nozzle disposed outwardly of said consumable wires, said multiport nozzle deflecting gas from a direction which is rotatable relative to said two wires, said rotating multiport nozzle containing a plurality of nonconverging ports arranged in a substantially semi-circular line pattern relative to and beside said molten particle stream and supplying a substantially steady uninterrupted encapsulating flow of deflecting gas simultaneously through all of said nonconverging ports at substantially equivalent flows thereof thereby continuously deflecting said molten metal particle stream radially outward towards a surface to be coated, wherein the multiport nozzle further contains a port for compressed gas which prevents the molten particle stream from contacting said multiport nozzle.

13. The apparatus of claim 12, wherein said plurality of nonconverging ports form a plurality of substantially semi-circular patterns which are staggered relative to one another.

14. The apparatus of claim 12, wherein there are three semi-circular patterns which are positioned at about 0.18, 0.25 and 0.31 inches in radial distance from said converging point of said wire electrodes.

15. In a thermal spray coating apparatus containing at least two consumable wire electrodes converging at a converging zone to produce a molten metal particle arc ball, including a stream of compressed gas passing through a gas port directed at said arc ball and passing around and forward of said converging zone to atomize said molten metal particle arc ball and drive a particle stream, wherein the flow of gas from said gas port produces a negative pressure between the arc ball and said gas port causing the arc ball to deposit on said gas port, the improvement which comprises the incorporation of a second flow of gas not directed at the arc ball and positioned behind said consumable electrodes to compensate for said negative pressure between the arc ball and said gas port thereby substantially maintaining the arc ball in position in the converging zone for atomization.

* * * * *